United States Patent [19]

Braun et al.

[11] 4,366,990

[45] Jan. 4, 1983

[54] MECHANISM FOR GUIDING A COAL PLANER ON THE TROUGH OF A SCRAPER CHAIN CONVEYOR

[75] Inventors: Ernst Braun; Gert Braun, both of Essen-Heisingen, Fed. Rep. of Germany

[73] Assignee: Halbach & Braun, Fed. Rep. of Germany

[21] Appl. No.: 231,807

[22] Filed: Feb. 5, 1981

[30] Foreign Application Priority Data

Feb. 9, 1980 [DE] Fed. Rep. of Germany ..... 3004891

[51] Int. Cl.[3] ..... E21C 27/35

[52] U.S. Cl. ..... 299/34

[58] Field of Search ..... 299/32, 34

[56] References Cited

U.S. PATENT DOCUMENTS 3,357,743 12/1967 Lobbe et al. ..... 299/34

3,388,948 6/1968 Lobbe et al. ..... 299/34

FOREIGN PATENT DOCUMENTS 1249794 9/1967 Fed. Rep. of Germany ..... 299/34

*Primary Examiner*—Ernest R. Purser

*Attorney, Agent, or Firm*—McGlew and Tuttle

[57] ABSTRACT

A device for guiding a coal planer having a planer body on a conveyor trough for planing a coal face, comprising, a shaped planer guide secured to a side of the trough facing the coal face having an upper and lower chain channel for receiving a moving chain for moving the planer body. The upper channel is open toward the coal face. The planer guide includes an upper guide rail embraced by a guide claw connected to the planer body. The guide claw has a portion extending into the upper chain channel. The upper guide rail has a vertical track surface and the planer guide has a horizontal track surface spaced from the vertical track surface on an opposite side of the open upper chain channel. Horizontally and vertically mounted rollers are provided in the guide claw for riding against the vertically and horizontally extending track surfaces.

7 Claims, 2 Drawing Figures

MECHANISM FOR GUIDING A COAL PLANER ON THE TROUGH OF A SCRAPER CHAIN CONVEYOR

FIELD AND BACKGROUND OF THE INVENTION

This invention relates to mining equipment in general and, in particular, to a new and useful mechanism for guiding a coal planer on the trough of a conveyor, particularly a scraper chain conveyor, which utilizes vertically and horizontally extending tracks engaged by vertical and horizontal rollers in a guide claw connected to the planer.

Coal planers are utilized to plane coal from a mine face by drawing cutting blades across the mine face which are carried by the planer. The coal is deposited onto the trough of a scraper chain conveyor which moves the coal.

In planer assemblies with a coal planer guided on the conveyor trough, the planer body slides on both the planer guide and the floor. The sliding friction causes considerable frictional losses and drag forces, so that only a limited amount of the applied power is utilized for the winning or planing and loading operation. Consequently, the traveling speed of the planer and the cutting depth must be reduced correspondingly. An output increase, however, requires higher speeds and cutting depths. Therefore, either the power supply must be increased or the frictional losses must be reduced. The present invention concentrates on the latter solution.

SUMMARY OF THE INVENTION

The present invention is directed to a mechanism of the above-mentioned kind in which the travel of the planer is facilitated, whereby, the performance thereof is considerably augmented.

The invention starts from the experience that the frictional losses of a sliding planer can be considerably reduced by substituting rolling friction for sliding friction. As is well known, the losses due to rolling friction, in general, are substantially lower than those due to sliding friction.

In the inventive guide mechanism, rolling friction is provided at the top of the planer guide, while at the bottom thereof, more particularly at point of contact with the mine floor, the sliding friction remains. By this combination of rolling and sliding friction, the traveling motion of the coal planer is substantially facilitated, i.e., the motion becomes substantially smoother. In addition, due to horizontal and vertical guidance by rollers, the support of the planer at the upper part of the planer guide is improved. This particularly applies to tilting moments about an axis parallel to the conveyor or mine face, which occur during operation. A further improvement in the planer motion is thereby obtained.

A slot-like opening is provided in a chain channel through which the guide claws extend into the channel. This is provided between the vertical track surface and the horizontal track surface. This opening is thus virtually limited by the two track surfaces, which is advantageous in manufacture, since the horizontal track surface can be provided as a protruding portion above a spline rod by which the planer guide segments are connected to each other.

In accordance with the invention, the horizontal and vertical guide rollers are mounted within the guide claws in overhung position, thus on vertical and horizontal journals which are secured to the guide claws. A plurality of alternately horizontal and vertical guide rollers may be mounted in a single guide claw. Advantageously, both the track surfaces and the guide rollers, or the rims thereof, are made of hardened material or are plated with such a material so that the wear which is already considerably low due to the rolling friction, is further reduced.

One most significant advantage of the invention is that the total frictional losses during the motion of the coal planer, which partly slides, but mainly rolls through rollers on the planer guide, are considerably reduced, due to the rolling friction. As a result, a much higher proportion of the applied power is available for the winning and loading operations than before, which means that with the same power supply, the speed of cutting and extraction can be increased. The output and efficiency is thereby improved. The traveling motion of the planer is also improved, due to the smooth run on the planer guide. The guide elements are subjected to a quite considerably lower wear. A bracing against torques is also improved. This is true particularly for the tilting moment about an axis in the direction of the planer travel. Finally, the guide rollers are easily exchangeable since they are mounted in the guide claws which are detachably screwed to the planer body.

Accordingly, an object of the present invention is to provide a device for guiding a planer having a planer body on a conveyor trough for planing a mine face, comprising, a shaped planer guide secured to a side of the trough facing the mine face having at least one chain channel for receiving a moving chain for moving the planer body which is open toward the mine face, and an upper guide rail, a guide claw connected to the planer body embracing the upper guide rail and having a portion extending into the chain channel for engaging the chain, the upper guide rail having a vertical track surface and the shaped planer body having a horizontal track surface, and first and second guide rollers rotatably mounted about respective vertical and horizontal axes in rolling contact with said vertical and horizontal track surfaces, respectively.

A further object of the invention is to provide such a device for guiding a coal planer for winning coal from a coal face and depositing it in the conveyor trough which is the trough of a scraper chain conveyor.

Another object of the invention is to provide a guiding mechanism for coal planers which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawing and descriptive matter in which a preferred embodiment of the invention is illustrated.

DESCRIPTION OF THE PREFERRED EMBODIMENT

Figures 1, 2:
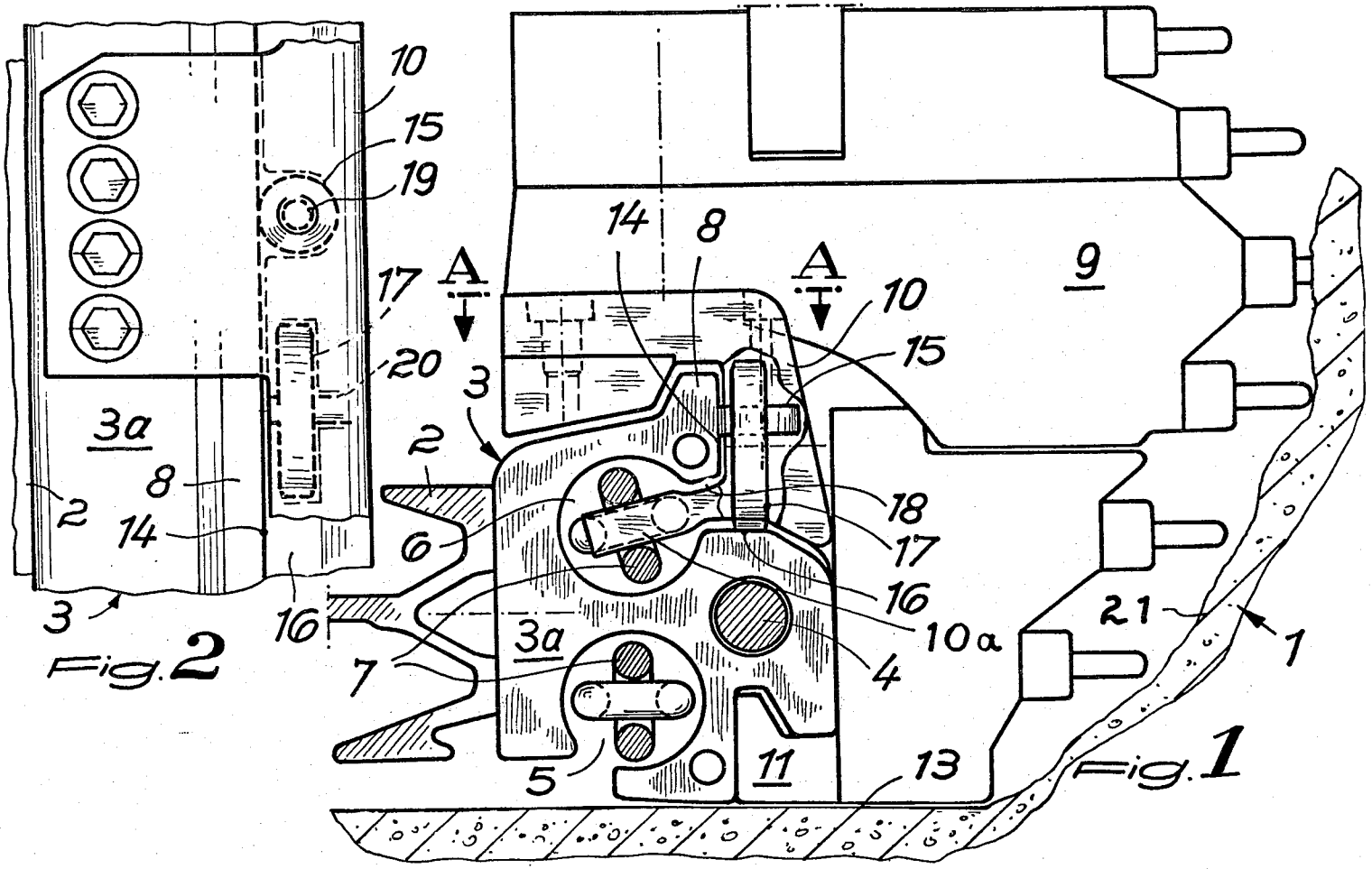
FIG. 1 is a vertical sectional view of a guide mechanism for a coal planer constructed in accordance with the invention.
FIG. 2 is a horizontal view, partly in section, taken along the line A—A of FIG. 1.

Referring to the drawings in particular, the figures show the inventive mechanism for guiding a coal planer 1 mounted on the conveyor trough 2 of a conveyor, particularly a screaper chain conveyor, comprising a planer guide 3 which is secured to conveyor trough 2 at the coal side and assembled of planer guide segments 3*a* articulating with each other. While one segment 3*a* is shown, a plurality of such segments are articulatedly connected together along a length of the coal or mine face 20, to form the overall guide.

Planer guide segments 3*a* are so to speak threaded on spline rods 4 which are elastically flexible. Planer guide 3 is formed with an upper and lower channel 5 and 6 for a planer chain 7 and with an upper guide rail 8. Low channel 5 contains the return length of chain 7. Rail 8 is embraced by guide claws 10 which are detachably secured to the body 9 of the planer and project into the upper chain channel 6 which is open at the coal face side, to be attached to the upper or driven section of planer chain 7 (only one claw 10 is shown). Guide claws 10 are screwed or bolted to planer body 9 and are provided at least at either end thereof, considered in the traveling direction of the planer. A central guide claw may also be provided. In addition, a spur 11 is provided at the bottom of planer body 9, engaging planer guide 3 from below.

Spur 11 slides both on planer guide 3 and on the floor 13. Guide rail 8 extends along the top of planer guide 3 and has a vertical track surface 14 for horizontal guide rollers 15, while below this track 14, planer guide 3 is provided at the coal side with an upwardly protruding horizontal track surface 16 for vertical guide rollers 17.

The horizontal and vertical guide rollers 15 and 17 are mounted for free rotation within guide claws 10. Therefore, rollers 15 and 17 may be easily removed from planer body 9 along with guide claws 10, for exchange. Between the vertical and the horizontal track surfaces 14 and 16, the coal side opening of the upper chain channel 6 is provided, i.e., a slot-like opening 18 is formed through which the lower portions 10*a* of guide claws 10 project into the channel.

Horizontal and vertical guide rollers 15 and 17 are mounted in overhung position on vertical and horizontal journals 19 and 20, respectively. A plurality of alternately horizontal and vertical guide rollers 15 and 17 may be mounted within a single guide claw 10 (not shown). Due to the support on rollers of coal planer 1 in the upper part of planer guide 3, the wear of the guide elements is considerably reduced. In addition, track surfaces 14, 16 and rollers 15, 17, or the rims of the rollers, may be made of, or plated with, hardened material.

While a specific embodiment of the invention has been shown and described in detail to illustrate the application of the principles of the invention, it will be understood that the invention may be embodied otherwise without departing from such principles.

What we claim is:

1. A device for guiding a planer having a planer body on a conveyor trough for planing a mine face, comprising:

a shaped planer guide formed of a plurality of segments articulatedly connected together along the mine face, said planer guide secured to a side of the through facing the mine face and having an upper and a lower chain channel for receiving a moving planer chain for moving the planer body, said upper chain channel being open toward the mine face, said planer guide having an upper guide rail;

a guide claw detachably connected to the planer body, embracing said upper guide rail and having a portion extending into said upper chain channel for engaging the chain;

said upper guide rail having a substantially vertical track surface and said shaped planer guide having a substantially horizontal track surface disposed below and adjacent said vertical track surface;

a first guide roller rotatably mounted about a vertical axis in said detachably connected guide claw in rolling contact with said vertical track surface; and a second guide roller rotatably mounted about a horizontal axis in said guide claw in rolling contact with said horizontal track surface;

said rollers mounted substantially above said upper chain channel.

2. The device according to claim 1, wherein said guide claw is bolted to the planer body.

3. The device according to claim 1, wherein the opening of said upper chain channel is positioned between said vertical track surface and said horizontal track surface with said guide claw portion extending into said upper chain channel between and adjacent said vertical and horizontal track surfaces.

4. The device according to claim 1, including a plurality of said first and second guide rollers alternately mounted along said guide claw in the direction of the mine face.

5. The device according to claim 1, including a spline rod opening extending through each of said planer guide segments aligned with each other and a spline rod extending through said spline rod openings connecting said planer guide segments together.

6. The device according to claim 1, wherein said first and second guide rollers are mounted in said guide claw in an overhung manner.

7. The device according to claim 1, including a plurality of said guide claws connected to a single one of the planer bodies.

* * * * *